US007428453B2

(12) United States Patent
Davenport et al.

(10) Patent No.: US 7,428,453 B2
(45) Date of Patent: Sep. 23, 2008

(54) SYSTEM AND METHOD FOR MONITORING TRAIN ARRIVAL AND DEPARTURE LATENCIES

(75) Inventors: David Michael Davenport, Niskayuna, NY (US); Rahul Bhotika, Niskayuna, NY (US); John Erik Hershey, Ballston Lake, NY (US); Robert James Mitchell, Waterford, NY (US); Emad Andarawis Andarawis, Ballston Lake, NY (US); Kenneth Brakeley Welles, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 482 days.

(21) Appl. No.: 11/317,533

(22) Filed: Dec. 23, 2005

(65) Prior Publication Data

US 2007/0150129 A1 Jun. 28, 2007

(51) Int. Cl.
*B61L 17/00* (2006.01)
*G06F 17/00* (2006.01)

(52) U.S. Cl. ..... 701/19; 701/117

(58) Field of Classification Search ..... None
See application file for complete search history.

(56) References Cited

U.S. PATENT DOCUMENTS

| | | | | |
|---|---|---|---|---|
| 4,520,662 | A | 6/1985 | Schmid | 79/129 |
| 4,610,206 | A * | 9/1986 | Kubala et al. | 104/26.1 |
| 4,838,173 | A | 6/1989 | Schroeder et al. | 105/35 |
| 5,586,669 | A | 12/1996 | Seay et al. | 213/43 |
| 5,735,491 | A | 4/1998 | Atkinson | 246/124 |
| 5,950,967 | A | 9/1999 | Montgomery | 246/182 |
| 6,206,215 | B1 | 3/2001 | Maa | 213/75 |
| 6,377,877 | B1 * | 4/2002 | Doner | 701/19 |
| 7,006,957 | B2 * | 2/2006 | Doner | 703/6 |
| 2002/0082814 | A1 * | 6/2002 | Doner | 703/6 |
| 2002/0084387 | A1 * | 7/2002 | Matheson et al. | 246/124 |
| 2003/0182030 | A1 | 9/2003 | Kraeling et al. | 701/19 |

FOREIGN PATENT DOCUMENTS

| | | | |
|---|---|---|---|
| JP | 2-108904 | * | 4/1990 |

* cited by examiner

*Primary Examiner*—Michael J. Zanelli
(74) *Attorney, Agent, or Firm*—Shawn A. McClintic

(57) ABSTRACT

Methods and systems for monitoring trains in a railyard. These methods and systems detect an incoming train entering a geographic area defined by a railyard, store an entry time indicative of a time at which the incoming train entering the railyard was detected, detect the incoming train coming to a stop in a subyard of the railyard, store a stop time indicative of a time at which the incoming train came to a stop in the receiving subyard, calculate an incoming train latency time by subtracting the entry time from the stop time, and store the incoming train latency time as an incoming train latency time record.

20 Claims, 5 Drawing Sheets

SYSTEM AND METHOD FOR MONITORING TRAIN ARRIVAL AND DEPARTURE LATENCIES

BACKGROUND

This invention relates generally to railyards and, more particularly, to monitoring train arrival and departure latencies for a railyard.

Railyards are the hubs of railroad transportation systems. Therefore, railyards perform many services, for example, freight origination, interchange and termination, locomotive storage and maintenance, assembly and inspection of new trains, servicing of trains running through the facility, inspection and maintenance of railcars, and railcar storage. The various services in a railyard compete for resources such as personnel, equipment, and space in various facilities so that managing the entire railyard efficiently is a complex operation.

In order to improve the efficiency of railyard operations, it would be useful for an automatic system to monitor the times at which trains enter a geographic area defining a railyard and, subsequently, leave the railyard. Determination of train entry and exit from the railyard is currently accomplished using automatic equipment identification (AEI) tag readers located at the geographic limits of the railyard. A train is comprised of pieces of rolling stock, such as one or more locomotives and one or more railcars, that are removably coupled together using mechanical coupling links. Typically, an AEI tag is attached to every piece of rolling stock in the train. The AEI tag includes coded information that uniquely identifies the piece of rolling stock to which it is attached. As a train enters a railyard, each piece of rolling stock passes an AEI reader, and the reader thereby collects identification information from the AEI tag. The AEI reader transmits RF energy towards a tag reading area and receives RF energy that is backscattered by an AEI tag situated within the tag reading area.

AEI tag reading systems are expensive and complicated to install. Electrical power must be routed to the tag readers, and the tag readers must be accurately aligned with respect to the set of railroad tracks that are to be monitored. Due to the amount of RF energy that must be transmitted by the AEI tag reader so as to obtain tag readings, some of this energy travels beyond the limits of the railyard where it may interfere with communications equipment. Accordingly, AEI tag reading systems are regulated by the Federal Communications Commission (FCC). A license must be obtained from the FCC in order to operate an AEI tag reading system within the United States.

The times at which trains enter and exit the railyard may create a potentially inaccurate picture of railyard operations unless additional information is acquired. An inbound train is considered to be "yarded" as soon as it enters the geographic limits of the railyard. However, due to congestion, crew availability, yard conditions, or other factors, it may not be possible to bring the train immediately into a receiving subyard so as to complete a train arrival process. Each individual railcar is delayed, thus impacting the performance metrics of the entire railyard and possibly causing delays in subsequent outbound trains from that yard. Accordingly, it would be desirable to minimize the time that elapses after a train enters the railyard, but before the train comes to a stop in a receiving subyard. It would also be desirable to minimize the time that elapses after a train enters a departure subyard, but before the train leaves the geographic limits of the railyard. These elapsed times, referred to as latencies, are not measured by existing automated railyard systems.

In addition to monitoring the times at which trains enter and exit a railyard, it would also be useful to monitor one or more sets of tracks within the railyard that may be occupied by a train. Track occupancy is currently monitored by installing wheel detectors along the tracks, or by installing track circuits over track segments. Both of these approaches require significant capital expenditure, installation labor, and electrical cable trenching which disrupts operations within the railyard. The foregoing considerations render existing track occupancy monitoring approaches undesirable and prohibitive. Accordingly, what is needed is a technique for monitoring train arrival and departure latencies which does not require deployment of equipment to individual tracks or individual locomotives.

SUMMARY OF THE INVENTION

Pursuant to one set of embodiments, computer-executable methods are provided for monitoring trains in a railyard. These methods comprise detecting an incoming train entering a geographic area defined by a railyard, storing an entry time indicative of a time at which the incoming train entering the railyard was detected, detecting the incoming train coming to a stop in a subyard of the railyard, storing a stop time indicative of a time at which the incoming train came to a stop in the receiving subyard, calculating an incoming train latency time by subtracting the entry time from the stop time, and storing the incoming train latency time as an incoming train latency time record.

Pursuant to a set of further embodiments, the method comprises detecting an outgoing train accelerating from a stop in a departure subyard of the railyard, storing a start time indicative of a time at which the outgoing train in the departure subyard commenced motion from a stationary position, detecting an outgoing train departing from the railyard, storing a departure time indicative of a time at which departure of the outgoing train from the railyard was detected, calculating an outgoing train latency time by subtracting the start time from the departure time, and storing the outgoing train latency time as an outgoing train latency time record.

Pursuant to another set of embodiments, a railyard management system is provided. The railyard management system comprises: a train motion sensing mechanism capable of detecting an incoming train entering a geographic area defined by a railyard, and capable of detecting the incoming train coming to a stop in a subyard of the railyard; a computer-readable storage medium; and a processing mechanism coupled to the computer-readable storage medium. In response to the train motion sensing mechanism detecting the incoming train entering the railyard, the processing mechanism is programmed to store an entry time in the computer-readable storage medium indicative of a time at which the incoming train entering the railyard was detected by the sensing mechanism. In response to the train motion sensing mechanism detecting the incoming train coming to a stop within a receiving subyard of the railyard, the processing mechanism is programmed to store a stop time in the computer-readable storage medium indicative of a time at which the incoming train came to a stop in the receiving subyard. The processing mechanism is programmed to calculate an incoming train latency time by subtracting the entry time from the stop time, and to store the incoming train latency time in the computer-readable storage medium as an incoming train latency time record.

Pursuant to a further set of embodiments, the railyard management system is capable of detecting an outgoing train accelerating from a stop in a departure subyard of the railyard, and capable of detecting an outgoing train departing from the railyard. In response to the train motion sensing mechanism detecting the outgoing train accelerating from a stop in the departure subyard of the railyard, the processing mechanism stores a start time in the computer-readable storage medium indicative of a time at which the outgoing train in the departure subyard commenced motion from a stationary position. In response to the train motion sensing mechanism detecting the outgoing train departing from the railyard, the processing mechanism stores a departure time in the computer-readable storage medium indicative of a time at which departure of the outgoing train from the railyard was detected. The processing mechanism is programmed to calculate an outgoing train latency time by subtracting the start time from the departure time, and to store the outgoing train latency time in the computer-readable storage medium as an outgoing train latency time record.

DETAILED DESCRIPTION OF EXEMPLARY EMBODIMENTS OF THE INVENTION

Figure 1:
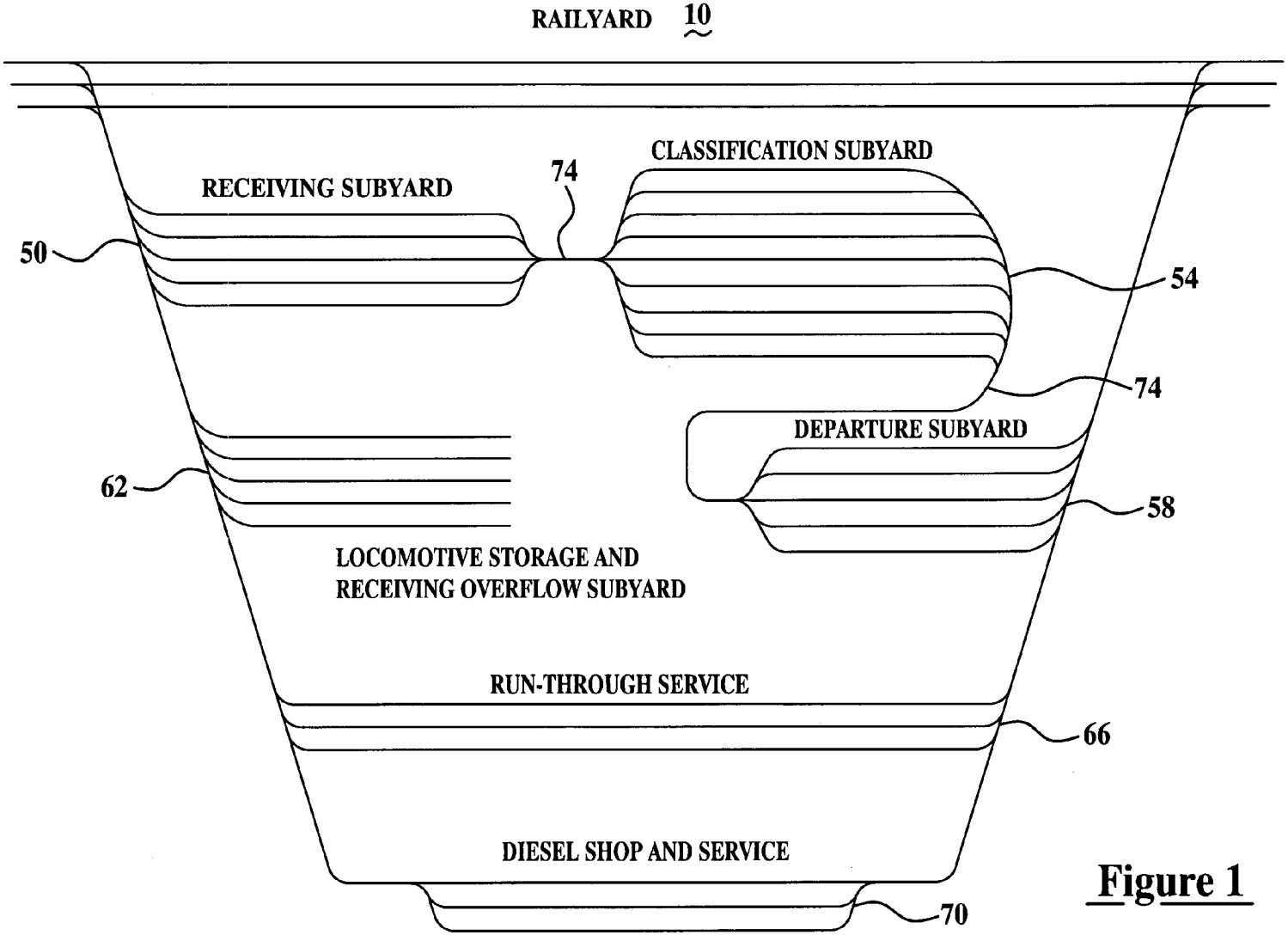
FIG. 1 is a diagram of a railyard for illustrating the various areas of the railyard that trains pass through during railyard processing.

FIG. 1 is a diagram of a railyard 10 for illustrating the various areas of the railyard that trains pass through during railyard processing. Railyard 10 includes various sets of tracks dedicated to specific uses and functions. For example, an incoming train arrives in a receiving subyard 50 and is assigned a specific receiving track. At some later time, a switch engine enters the receiving track and moves the railcars into a classification subyard 54. Classification subyard 54 is sometimes referred to as a "bowl". The tracks in classification subyard 54 are assigned to hold specific blocks of railcars being assembled for outbound trains. When assembly of a block of railcars is completed, this block of railcars is assigned to a specific track in a departure subyard 58 reserved for assembling a specific outgoing train.

When all blocks of railcars required for an outgoing train are assembled, one or more locomotives from a locomotive storage and receiving overflow subyard 62 will be moved and coupled to the assembled railcars. Railyard 10 also includes a run-through service area 66 for servicing railcars, and a diesel shop and service area 70 to service and repair locomotives. The organization of railyard 10 normally includes a number of throats, or bottlenecks 74, through which all cars involved in the foregoing train assembly process must pass. Bottlenecks 74 limit the amount of parallel processing possible in a yard, and limit the rate at which the sequence of train assembly tasks may occur.

Figure 2:
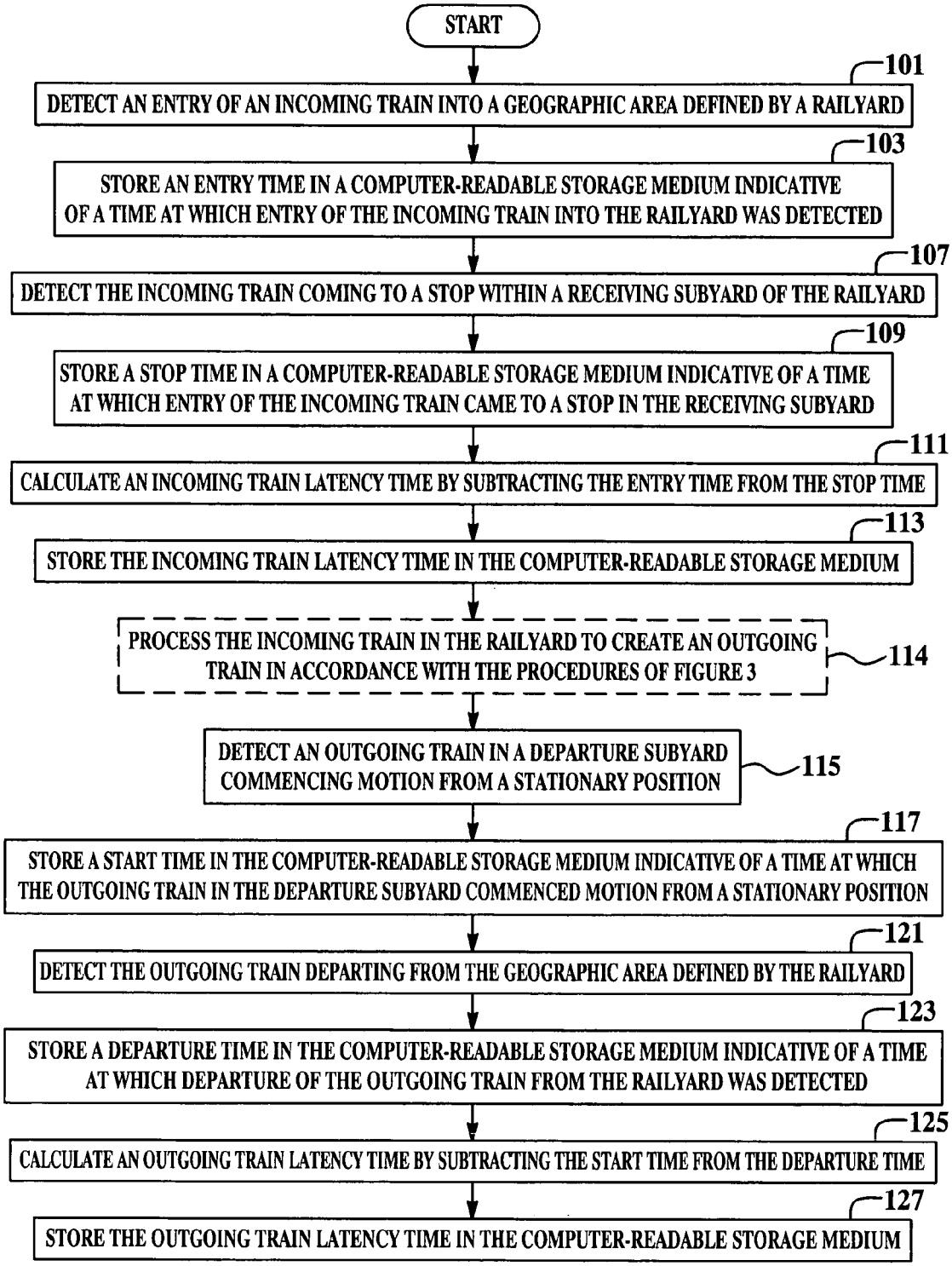
FIG. 2 is a flowchart showing a method for monitoring train arrival and departure latencies in the railyard of FIG. 1 in accordance with a set of embodiments of the present invention.

FIG. 2 is a flowchart showing a method for monitoring train arrival and departure latencies in railyard 10 (FIG. 1) in accordance with a set of embodiments of the present invention. The operational sequence commences at block 101 where an incoming train is detected entering a geographic area defined by railyard 10 (FIG. 1). An entry time is stored in a computer-readable storage medium (FIG. 2, block 103). The entry time is indicative of the time at which entry of the incoming train into the railyard was detected. At block 107, the incoming train coming to a stop within a receiving subyard of the railyard (for example, receiving subyard 50 of FIG. 1) is detected. A stop time is stored in the computer-readable storage medium which is indicative of the time at which the incoming train came to a stop in the receiving subyard (FIG. 2, block 109). An incoming train latency time is calculated by subtracting the entry time from the stop time (block 111). The incoming train latency time is stored in the computer-readable storage medium (block 113). Optionally, the incoming train is processed in the railyard to create an outgoing train in accordance with the procedures of FIG. 3. These procedures may, but need not, include the train assembly processes previously discussed above in connection with FIG. 1.

Next, an outgoing train is detected in a departure subyard (for example, departure subyard 58 of FIG. 1) commencing motion from a stationary position (FIG. 2, block 115). A start time is stored in the computer-readable storage medium which is indicative of a time at which the outgoing train in the departure subyard commenced motion from a stationary position (block 117). The outgoing train is then detected departing from the geographic area defined by the railyard (block 121). A departure time is stored in the computer-readable storage medium indicative of a time at which departure of the outgoing train from the railyard was detected (block 123). An outgoing train latency time is calculated by subtracting the start time from the departure time (block 125). The outgoing train latency time is stored in the computer-readable storage medium (block 127). It should be noted that the incoming and outgoing trains may consist of some or none of the same railcars or locomotives. For the purpose of this invention, incoming and outgoing trains may represent two independent entities comprised of one or more locomotives coupled to one or more railcars.

Figure 3:
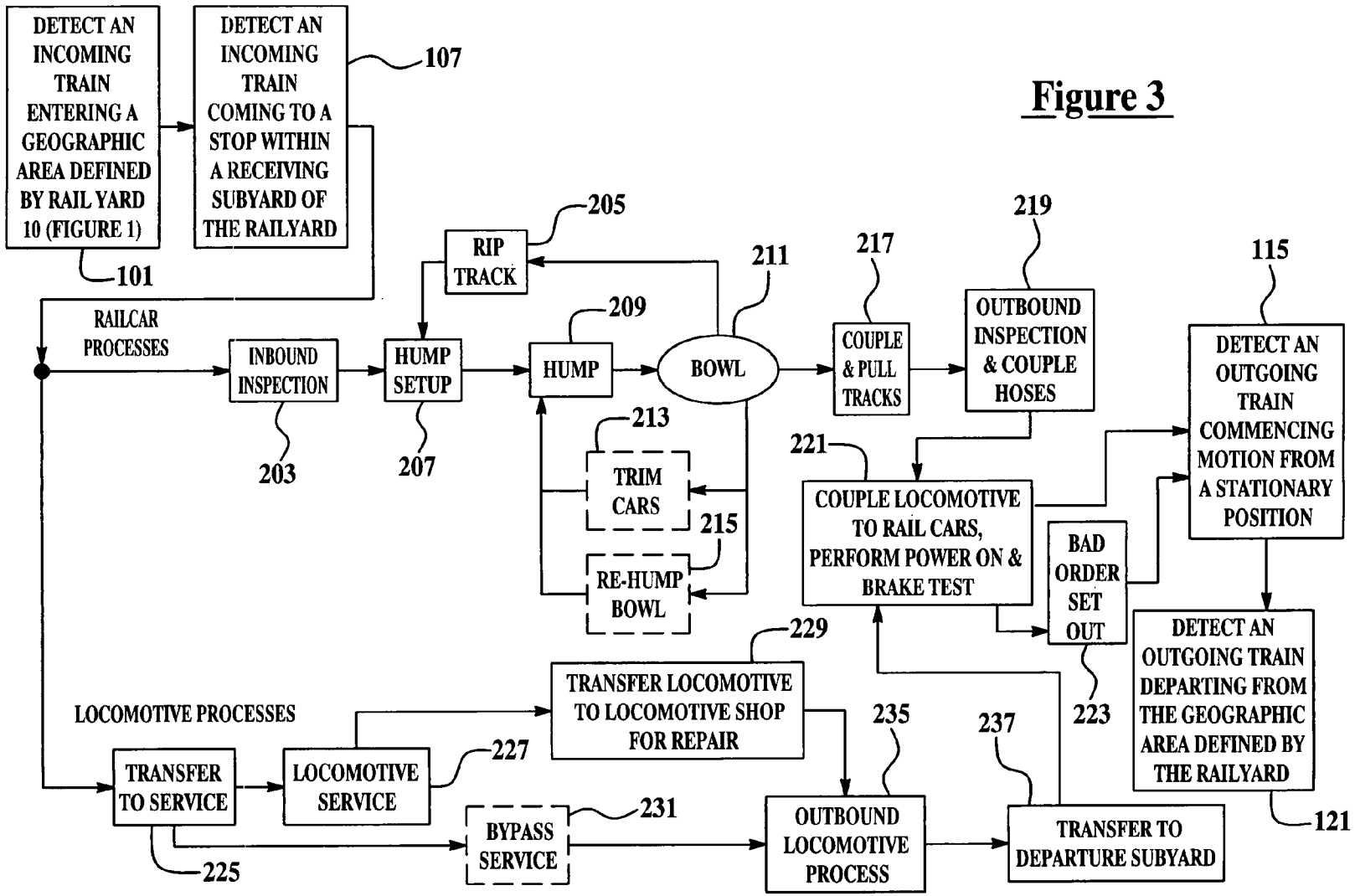
FIG. 3 a flowchart depicting a sequence of railyard processing operations performed upon a train entering the railyard of FIG. 1.

FIG. 3 a flowchart depicting a sequence of railyard processing operations performed upon an incoming train entering railyard 10 (FIG. 1). The incoming train includes at least one locomotive and at least one railcar. The sequence of railyard operations includes railcar processes (blocks 203-223) and locomotive processes (blocks 225-237). At block 101 (FIGS. 2 and 3), an incoming train is detected entering a geographic area defined by a rail yard 10 (FIG. 1). Next, the incoming train is detected coming to a stop within a receiving subyard of the railyard (FIGS. 2 and 3, block 107). An inbound inspection of the railcars is performed (block 203). Preparations are made to 'hump' the railcars (block 207), and the railcars are then 'humped' (block 209).

"Humping" refers to the process of classifying railcars by pushing them over a hill or summit (known as a 'hump'), beyond which the cars are propelled by gravity and switched to any of a plurality of individual tracks in a bowl 211. Bowl 211 may also be referred to as classification subyard 54 (FIG. 1). By way of example, humping may involve separating a first railcar from a second railcar, and pushing the first railcar over a hill or summit (known as a 'hump'), beyond which the first railcar is propelled by gravity and switched to a first track in classification subyard 54. The second railcar is separated from any remaining railcars in the plurality of railcars, pushed over the hump, propelled by gravity, and switched to a second track in classification subyard 54. While one primary embodiment refers to classification subyard 54 as using a hump to separate railcars, other embodiments are applicable to railyards which do not employ a hump, such as so-called flat-yards.

Once the railcars are classified using bowl 211 (FIG. 3), some railcars may optionally be trimmed (block 213). Trimming refers to the movement or relocation of a railcar among the various tracks of classification subyard 54. Moreover, bowl 211 may, but need not, be re-humped (block 215). After the railcars are classified and any optional trimming or re-humping is performed, the classified railcars are coupled (block 217) and pulled along classification subyard 54 (FIG. 1) through bottleneck 74 to departure subyard 58. At block 219 (FIG. 3), an outbound inspection of the coupled railcars is performed, and one or more pneumatic air brake hoses are coupled together. A power-on test is performed to verify proper brake operation (block 221). Any railcars which have mechanical defects that would prevent safe operation on the mainline track outside of the railyard are placed on a bad order set out track of the railyard (block 223).

The locomotive processes of blocks 225-237 may be performed before, after, or contemporaneously with the railcar processes of blocks 203-221. At block 225, a locomotive is separated from its railcars and transferred into service from locomotive storage and receiving overflow subyard 62 (FIG. 1). If locomotive service (FIG. 3, block 227) is to be performed, the locomotive is transferred (block 229) to diesel shop and service 70 (FIG. 1). If locomotive service is not to be performed, service is bypassed (FIG. 3, block 231). After locomotive service is performed (block 229) or bypassed (block 231), an outbound locomotive process is performed (block 235). At block 237, the locomotive is transferred to departure subyard 58 (FIG. 1). The locomotive is coupled to the processed railcars (FIG. 3, blocks 203-221), and a power-on and brake test is then performed. The locomotive and processed railcars depart from departure subyard 58 (FIG. 1) as an outgoing train, such that the outgoing train is detected commencing motion from a stationary position (FIG. 3, block 115). The outgoing train is then detected departing from the geographic area defined by the railyard (FIGS. 2 and 3, block 121).

Figure 4:
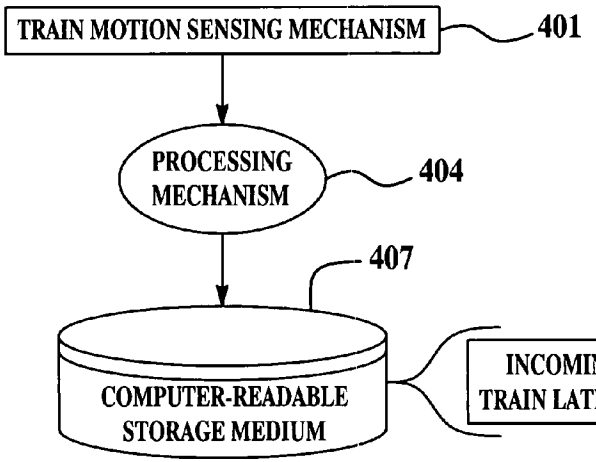
FIG. 4 is a schematic block diagram of an overall system for monitoring train arrival and departure latencies in accordance with a set of embodiments of the present invention.

FIG. 4 is a schematic block diagram of a system for monitoring train arrival and departure latencies for railyard 10 (FIG. 1) in accordance with a set of embodiments of the present invention. A train motion sensing mechanism 401 (FIG. 4) is capable of sensing motion of a train that includes at least one locomotive and at least one railcar. More specifically, train motion sensing mechanism 401 is capable of detecting an incoming train entering railyard 10 (FIG. 1), an outgoing train departing from the railyard, an incoming train coming to a stop in a receiving subyard of the railyard, and an outgoing train accelerating from a stop in a departure subyard of the railyard. Illustratively, train motion sensing mechanism 401 (FIG. 4) is implemented using an automatic equipment identification (AEI) tag reader, a radar transceiver, a LIDAR (light detection and ranging) transceiver, a receiver capable of receiving RF signals transmitted by an end of train (EOT) device, a receiver capable of receiving RF signals transmitted by a one-way telemetry device on the train, or any of various combinations thereof.

AEI tag readers present a robust and reliable option for determining the time at which an incoming train enters the geographic limits of a railyard, as well as the time at which an outgoing train exits the geographic limits of the railyard. However, in situations where extensive under-rail cabling must be installed to provide power for the AEI tag readers, this approach may prove costly. Soil in the vicinity of railroad tracks may be heavily compacted. Moreover, cable trenching equipment may disrupt rail operations throughout railyard 10 (FIG. 1).

As stated above, train motion sensing mechanism 401 may be implemented using signals received from an EOT device. This EOT device may be a one-way or two-way telemetry device. In the United States, the Federal Railroad Administration (FRA) mandates the use of two-way, brake line, EOT telemetry devices, for certain types of trains. These types of trains are described in greater detail at 49 CFR Ch. II, Oct. 1, 2004, Section 232.407. However, many types of trains that do not require two-way EOT brake line telemetry devices use one-way EOT telemetry devices. One-way EOT telemetry devices use a radio transmitter to transmit a signal indicative of train brake line pressure (i.e., braking status) from the last car in the train to the head end of the train where the lead locomotive is situated. Two-way EOT devices add the ability to command air brake activation at the rear of the train from the engineer at the head end of the train.

The American Railway Engineering and Maintenance of Way Association (AREMA) defines recommended guidelines for EOT telemetry systems in its Communications and Signals Manual (AREMA C&S Manual, Part 22.3.1, 2004). Furthermore, the FRA mandates testing of EOT devices upon installation on a train and before a train's departure from a railyard (see 49 CFR Ch. II, Oct. 1, 2004, Section 232.409). One effect of these regulations is that EOT devices are found on most trains. EOT devices present a source of information for detecting the approach of a train to a railyard. Using the AREMA recommended, industry standard message format, the train brake line status can be decoded from EOT radio messages and used to recognize a train that has stopped, as well as a train that is in motion. EOT radio messages may be received using a radio receiver of conventional design coupled to one or more directional antennas. The use of directional antennas permits the radio receiver to limit detection of approaching trains to those trains within certain geographic areas or regions.

A receiver can be monitored for detection of incoming EOT radio messages. When an EOT radio message is received, a warning or indication of an approaching train is provided. For example, consider U.S. Pat. No. 5,735,491 (hereinafter referred to as the '491 patent) which discloses a system to warn motorists of a train approaching a railroad crossing by detecting a train via reception of its EOT radio signal. The '491 patent does not teach or suggest demodulation or extraction of any specific data contained within the EOT radio signal to determine train braking status. Train braking status may, but need not, include brake line pressure, or information specifying whether the brakes are currently being applied to the train, or both.

If train motion sensing mechanism 401 is implemented using a radar or LIDAR transceiver, electromagnetic energy in the form of a radar or LIDAR interrogation signal is transmitted from one or more positions within or adjacent to the railyard. Preferably, these positions are elevated above ground level so as to provide a relatively unobstructed signal path to each of a plurality of tracks or track segments. The radar or LIDAR transceiver is equipped with a controllable transmitting aperture in order to direct the interrogation signal towards a particular track or track segment. Any backscattered return signal from the interrogation signal is processed to yield a track occupancy state for the track or track segment, and may also be processed to determine relative motion of a train on the track with respect to the transmitting aperture.

Train motion sensing mechanism 401 is operatively coupled to a processing mechanism 404. Processing mechanism 404 is connected to a computer-readable storage medium 407 capable of storing a plurality of incoming and outgoing train latency time records 409 pursuant to execution of blocks 113 and 127 (FIG. 2). Computer-readable storage medium may comprise, for example, a disk drive, a magnetic storage medium, an optical storage device such as a CD-ROM or DVD, semiconductor memory, or various combinations thereof.

Processing mechanism 404 (FIG. 4) may be may implemented, for example, using a personal computer, laptop computer, mainframe computer, server, microprocessor-based device, or microcontroller operating in response to a computer program capable of implementing the procedures described above in connection with FIG. 2. In order to perform the prescribed functions and desired processing, as well as the computations therefore, the controller may include, but not be limited to, a processor(s), computer(s), memory, storage, register(s), timing, interrupt(s), communication interfaces, and input/output signal interfaces, as well as combinations comprising at least one of the foregoing. By way of example, a suitable microprocessor-based device may include a microprocessor connected to an electronic storage medium capable of storing executable programs, procedures or algorithms and calibration values or constants, as well as data buses for providing communications (e.g., input, output and within the microprocessor) in accordance with known technologies.

Algorithms for implementing exemplary embodiments of the present invention, including the procedure of FIG. 2, can be embodied in the form of computer-implemented processes and apparatuses for practicing those processes. The algorithms can also be embodied in the form of computer program code containing instructions embodied in tangible media, such as floppy diskettes, CD-ROMs, hard drives, or any other computer-readable storage medium, wherein, when the computer program code is loaded into and executed by a computer and/or controller, the computer becomes an apparatus for practicing the invention. Existing systems having reprogrammable storage (e.g., flash memory) that can be updated to implement various aspects of command code, the algorithms can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer. When implemented on a general-purpose microprocessor, the computer program code segments configure the microprocessor to create specific logic circuits.

These instructions may reside, for example, in RAM of the computer or controller. Alternatively, the instructions may be contained on a data storage device with a computer readable medium, such as a computer diskette. Or, the instructions may be stored on a magnetic tape, conventional hard disk drive, electronic read-only memory, optical storage device, or other appropriate data storage device. In an illustrative embodiment of the invention, the computer-executable instructions may be lines of compiled C++ compatible code.

Figure 5:
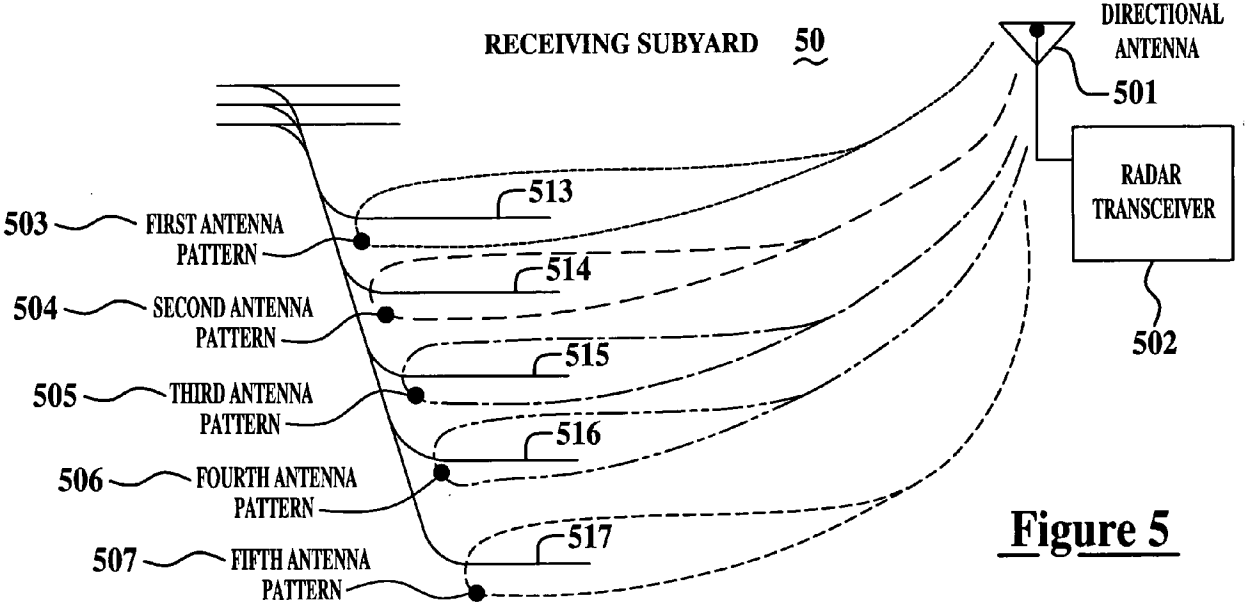
FIG. 5 is a diagrammatic representation of a first exemplary train motion sensing mechanism for use with the system of FIG. 4.

FIG. 5 is a diagrammatic representation of a first exemplary train motion sensing mechanism 401 (FIG. 4) implemented using a radar transceiver 502 coupled to a steerable directional antenna 501. Electromagnetic energy in the form of an interrogation signal in the ultra-high frequency (UHF) or microwave frequency range is transmitted from one or more positions within or adjacent to the railyard. In the example of FIG. 5, receiving subyard 50 of railyard 10 (FIG. 1) is shown for purposes of illustration, it being understood that the interrogation signal may be transmitted throughout all or only a portion of railyard 10, depending upon the specifics of a given system application. Moreover, steerable directional antenna 501 (FIG. 5) may be implemented using a plurality of discrete antennas mounted at one or more locations at or near railyard 10 (FIG. 1) and coupled to radar transceiver 502 (FIG. 5). For example, steerable directional antenna 501 may include a first directional antenna array providing coverage of receiving subyard 50 (FIG. 1), and a second directional antenna array that would provide coverage of departure subyard 58 (FIG. 1).

Steerable directional antenna 501 (FIG. 5) is "steerable" in the sense that it is equipped with a transmitting aperture controlling mechanism for controlling the directional characteristics of the antenna, so as to direct the interrogation signal towards a particular track or track segment. For example, steerable directional antenna 501 may be adjusted to provide a first antenna pattern 503 covering a first track segment 513 of receiving subyard 50, a second antenna pattern 504 covering a second track segment 514, a third antenna pattern 505 covering a third track segment 515, a fourth antenna pattern 506 covering a fourth track segment 516, and a fifth antenna pattern 507 covering a fifth track segment 517.

Any backscattered return signal from the interrogation signal received by steerable directional antenna 501 is processed to yield a track occupancy state for a track or track segment specifying whether or not any rolling stock, such as a locomotive or railcar, is situated on the track or track segment. The backscattered return signal may also be processed to determine relative motion of a train on the track or track segment with respect to the transmitting aperture of steerable directional antenna 501. Preferably, steerable directional antenna 501 is mounted in one or more positions elevated above ground level so as to provide a relatively unobstructed signal path to each of a plurality of tracks or track segments 513-517.

Figure 6:
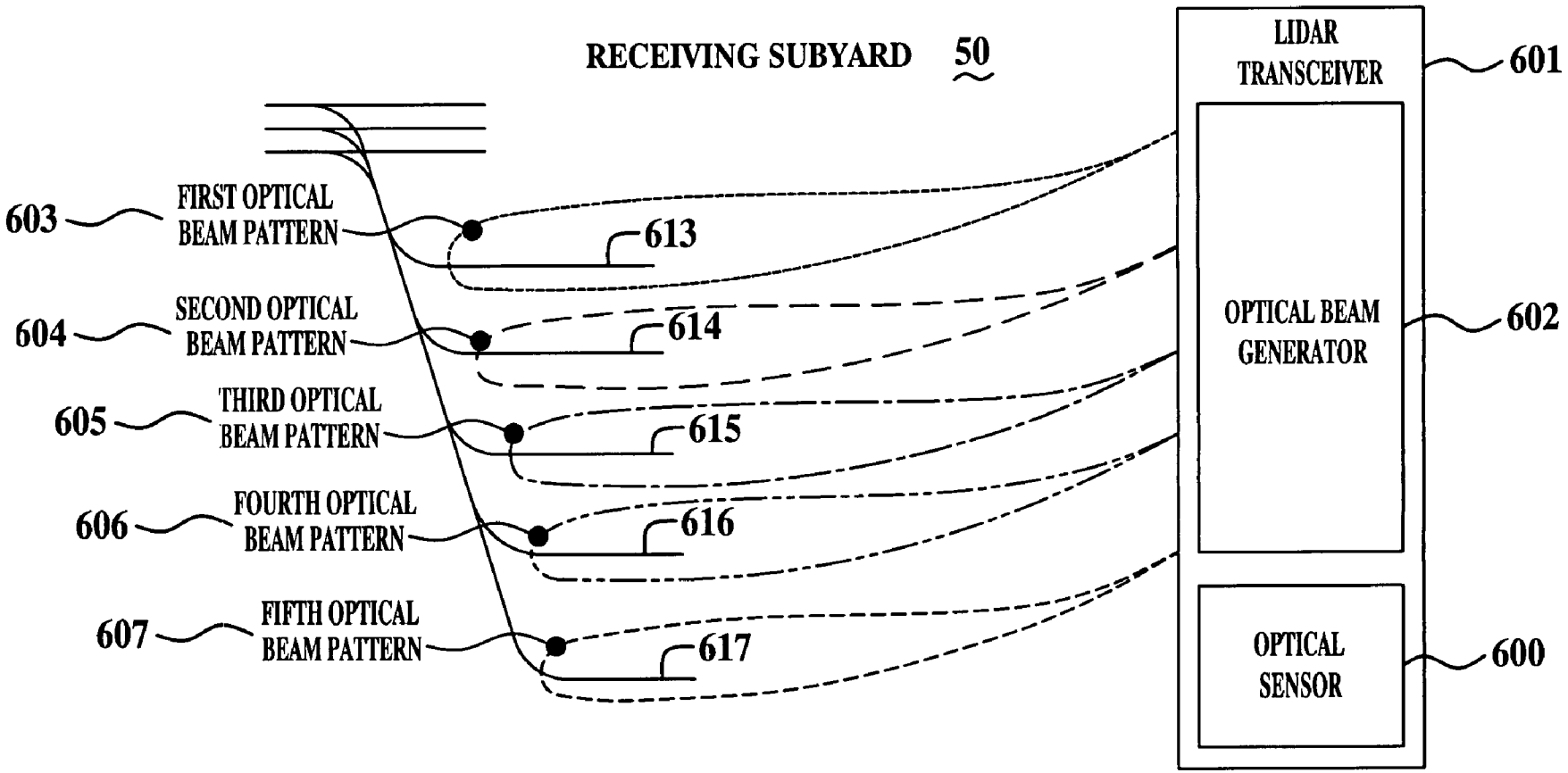
FIG. 6 is a diagrammatic representation of a second exemplary train motion sensing mechanism for use with the system of FIG. 4.

FIG. 6 is a diagrammatic representation of a second exemplary train motion sensing mechanism 401 (FIG. 4) implemented using a light detection and ranging (LIDAR) transceiver 601 coupled to an optical beam generator 602 and an optical sensor 600. Optical energy in the form of an interrogation signal in the infrared, visible, or ultraviolet wavelength range is transmitted from one or more positions within or adjacent to the railyard. In the example of FIG. 6, receiving subyard 50 of railyard 10 (FIG. 1) is shown for purposes of illustration, it being understood that the interrogation signal may be transmitted throughout all or only a portion of railyard 10, depending upon the specifics of a given system application. Moreover, optical beam generator 602 (FIG. 6) may be implemented using a plurality of discrete beam generators mounted at one or more locations at or near railyard 10 (FIG. 1) and coupled to LIDAR transceiver 601 (FIG. 6). For example, optical beam generator 602 may include a first beam generator providing coverage of receiving subyard 50 (FIG. 1), and a second beam generator that would provide coverage of departure subyard 58 (FIG. 1).

At least one of optical beam generator 602 and optical sensor 600 (FIG. 6) are "steerable" in the sense that they are equipped with a beam aperture controlling mechanism. If optical beam generator 602 is equipped with a beam aperture controlling mechanism, this mechanism controls the direction or directions to which an optical beam will be transmitted. The optical beam is controlled so as to direct the interrogation signal towards a particular track or track segment. If optical sensor 600 is equipped with a beam aperture controlling mechanism, this mechanism controls the direction or directions from which an optical beam will be received. Optical beams reflected from a particular track or track segment will be received by optical sensor 600, whereas optical beams not reflected from a particular track or track segment will not be received.

In the example of FIG. 6, optical beam generator 602 is equipped with a beam aperture controlling mechanism so as to direct the interrogation signal towards a particular track or track segment. For example, optical beam generator 602 may be adjusted to provide a first optical beam pattern 603 covering a first track segment 613 of receiving subyard 50, a second optical beam pattern 604 covering a second track segment 614, a third optical beam pattern 605 covering a third track segment 615, a fourth optical beam pattern 606 covering a fourth track segment 616, and a fifth antenna pattern 607 covering a fifth track segment 617.

Any backscattered return signal from the interrogation signal received by optical sensor 600 is processed to yield a track occupancy state for a track or track segment specifying whether or not any rolling stock, such as a locomotive or railcar, is situated on the track or track segment. The backscattered return signal may also be processed to determine relative motion of a train on the track or track segment with respect to the transmitting aperture of optical beam generator 602. Preferably, optical beam generator 602 is mounted in one or more positions elevated above ground level so as to provide a relatively unobstructed signal path to each of a plurality of tracks or track segments 613-617.

Optionally, at least one of an incoming and an outgoing train is associated with an optical retroreflector for reflecting an optical beam incident thereupon in a direction back to the source of the optical beam. Optical beam generator 602 directs an interrogation signal towards a track segment, such as track segment 613. Optical sensor 600 is monitored for receipt of a return signal reflected back to the optical receiver from the optical retroreflector, thereby permitting identification of one or more specific incoming or outgoing trains on track segment 613.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A railyard management system comprising:

a train motion sensing mechanism capable of detecting an incoming train entering a geographic area defined by a railyard, and capable of detecting the incoming train coming to a stop in a subyard of the railyard;

a computer-readable storage medium; and a processing mechanism coupled to the computer-readable storage medium;

wherein, in response to the train motion sensing mechanism detecting the incoming train entering the railyard, the processing mechanism is programmed to store an entry time in the computer-readable storage medium indicative of a time at which the incoming train entering the railyard was detected by the sensing mechanism;

wherein, in response to the train motion sensing mechanism detecting the incoming train coming to a stop within a receiving subyard of the railyard, the processing mechanism is programmed to store a stop time in the computer-readable storage medium indicative of a time at which the incoming train came to a stop in the receiving subyard; and wherein the processing mechanism is programmed to calculate an incoming train latency time by subtracting the entry time from the stop time, and to store the incoming train latency time in the computer-readable storage medium as an incoming train latency time record.

2. The railyard management system of claim 1 wherein the train motion sensing mechanism is capable of detecting an outgoing train accelerating from a stop in a departure subyard of the railyard, and capable of detecting an outgoing train departing from the railyard, wherein, in response to the train motion sensing mechanism detecting the outgoing train accelerating from a stop in the departure subyard of the railyard, the processing mechanism stores a start time in the computer-readable storage medium indicative of a time at which the outgoing train in the departure subyard commenced motion from a stationary position;

wherein, in response to the train motion sensing mechanism detecting the outgoing train departing from the railyard, the processing mechanism stores a departure time in the computer-readable storage medium indicative of a time at which departure of the outgoing train from the railyard was detected; and wherein the processing mechanism is programmed to calculate an outgoing train latency time by subtracting the start time from the departure time, and to store the outgoing train latency time in the computer-readable storage medium as an outgoing train latency time record.

3. The railyard management system of claim 2 wherein the train motion sensing mechanism comprises a radar transceiver capable of transmitting and receiving radio signals within at least a portion of the railyard.

4. The railyard management system of claim 2 wherein the train motion sensing mechanism comprises a light detection and ranging (LIDAR) transceiver capable of transmitting and receiving optical energy within at least a portion of the railyard.

5. The railyard management system of claim 2 wherein the train motion sensing mechanism further comprises a track occupancy detection mechanism for detecting presence of at least one of an incoming and an outgoing train on a selected track of a plurality of tracks in the railyard.

6. The railyard management system of claim 5 wherein the train motion sensing mechanism comprises a radar transceiver coupled to a directional antenna having a steerable beam for directing radio signals towards the selected track.

7. The railyard management system of claim 5 wherein the train motion sensing mechanism comprises a LIDAR transceiver that uses a focusing mechanism to selectively direct a beam of optical energy towards the selected track.

8. The railyard management system of claim 2 wherein the train motion sensing mechanism comprises a receiver capable of receiving radio signals from at least one of: (i) a one-way, end of train (EOT) brake line telemetry device, or (ii) a two-way, EOT brake line telemetry device.

9. The railyard management system of claim 8 wherein the receiver is capable of demodulating radio signals received from at least one of the one-way, EOT brake line telemetry device or the two-way, EOT brake line telemetry device, to determine a braking status for at least one of an incoming train and an outgoing train.

10. The railyard management system of claim 2 wherein the train motion sensing mechanism comprises an optical receiver capable of receiving an optical backscatter signal from an optical retroreflector associated with at least one of the incoming train and the outgoing train.

11. A computer-executable method of monitoring trains in a railyard, the method comprising:

detecting an incoming train entering a geographic area defined by a railyard; storing an entry time indicative of a time at which the incoming train entering the railyard was detected;

detecting the incoming train coming to a stop in a subyard of the railyard;

storing a stop time indicative of a time at which the incoming train came to a stop in the receiving subyard;

calculating an incoming train latency time by subtracting the entry time from the stop time; and storing the incoming train latency time as an incoming train latency time record.

12. The method of claim 11 further comprising:

detecting an outgoing train accelerating from a stop in a departure subyard of the railyard, storing a start time indicative of a time at which the outgoing train in the departure subyard commenced motion from a stationary position;

detecting an outgoing train departing from the railyard;

storing a departure time indicative of a time at which departure of the outgoing train from the railyard was detected;

calculating an outgoing train latency time by subtracting the start time from the departure time; and storing the outgoing train latency time as an outgoing train latency time record.

13. The method of claim 12 wherein at least one of: detecting the incoming train entering the railyard, detecting the incoming train coming to a stop in the subyard, detecting the outgoing train commencing motion from a stationary position, and detecting the outgoing train departing from the railyard; is performed by transmitting and receiving radio signals within at least a portion of the railyard.

14. The method of claim 13 wherein transmitting radio signals within at least a portion of the railyard is performed by directing radio signals towards a selected track of a plurality of tracks in the railyard.

15. The method of claim 12 wherein at least one of: detecting the incoming train entering the railyard, detecting the incoming train coming to a stop in the subyard, detecting the outgoing train commencing motion from a stationary position, and detecting the outgoing train departing from the railyard; is performed by transmitting and receiving optical energy within at least a portion of the railyard.

16. The method of claim 15 wherein transmitting optical energy within at least a portion of the railyard is performed by directing a beam of optical energy towards a selected track of a plurality of tracks in the railyard.

17. The method of claim 12 further comprising detecting a presence of at least one of an incoming and an outgoing train on a selected track of a plurality of tracks in the railyard.

18. The method of claim 12 further comprising receiving radio signals from at least one of: (i) a one-way, end of train (EOT) brake line telemetry device, or (ii) a two-way, EOT brake line telemetry device.

19. The method of claim 18 further comprising the step of demodulating radio signals received from at least one of the one-way, EOT brake line telemetry device or the two-way, EOT brake line telemetry device, to determine a braking status for at least one of an incoming train and an outgoing train.

20. The method of claim 12 further comprising receiving an optical backscatter signal from an optical retroreflector associated with at least one of the incoming train and the outgoing train.

* * * * *